US012024844B2

(12) United States Patent
Beretta

(10) Patent No.: US 12,024,844 B2
(45) Date of Patent: Jul. 2, 2024

(54) MONOLITHIC RETICULAR STRUCTURE FOR GEO GRIDS

(71) Applicant: SAC INDUSTRIALE SA, Engelberg (CH)

(72) Inventor: Cesare Beretta, Castagnola (CH)

(73) Assignee: SAC INDUSTRIALE SA, Engelberg (CH)

( * ) Notice: Subject to any disclaimer, the term of this patent is extended or adjusted under 35 U.S.C. 154(b) by 291 days.

(21) Appl. No.: 17/429,418

(22) PCT Filed: Feb. 10, 2020

(86) PCT No.: PCT/IB2020/051013
§ 371 (c)(1),
(2) Date: Aug. 9, 2021

(87) PCT Pub. No.: WO2020/165726
PCT Pub. Date: Aug. 20, 2020

(65) Prior Publication Data

US 2022/0145570 A1 May 12, 2022

Related U.S. Application Data

(60) Provisional application No. 62/804,274, filed on Feb. 12, 2019.

(51) Int. Cl.
*E02D 17/20* (2006.01)
*B29C 55/12* (2006.01)
*E02D 29/02* (2006.01)

(52) U.S. Cl.
CPC ..... *E02D 17/202* (2013.01); *E02D 29/0241* (2013.01); *E02D 2300/0006* (2013.01)

(58) Field of Classification Search
CPC ..... E02D 17/202; E02D 29/0241; E02D 2300/0006; E02B 3/122; B29C 55/12; B29C 55/14; B29C 55/143; B29C 55/146
See application file for complete search history.

(56) References Cited

U.S. PATENT DOCUMENTS 3,554,853 A * 1/1971 Mercer ..... B29C 48/08 428/167
4,662,946 A 5/1987 Mercer
(Continued)

FOREIGN PATENT DOCUMENTS

CN 201826295 U * 5/2011
CN 201826295 U 5/2011
(Continued)

OTHER PUBLICATIONS

Search Report dated May 25, 2020 in corresponding International Application No. PCT/IB2020/051013, 3 pages.
(Continued)

*Primary Examiner* — Frederick L Lagman
*Assistant Examiner* — Stacy N Lawson
(74) *Attorney, Agent, or Firm* — MH2 TECHNOLOGY LAW GROUP LLP

(57) ABSTRACT

A reticular structure includes first elements distanced from each other and having an elongated conformation according to a first prevalent development trajectory, and second elements distanced from each other and having an elongated conformation according to a second prevalent development trajectory orthogonal, to the first prevalent development trajectory of the first elements. The first and second elements intersect at nodes to form meshes. The first elements have at a mid-portion defined between two consecutive nodes and orthogonally to the first prevalent development trajectory and a substantially T-shaped section including a base and a protuberance emerging orthogonally from the base. The second elements have, at a mid-portion defined between two immediately consecutive nodes and orthogonally to the second prevalent development path, a respective elongated base joined in a single piece to the base of the first elements
(Continued)

to define a bottom surface of the reticular structure opposed to the protuberance of the first elements.

15 Claims, 7 Drawing Sheets

(56) References Cited

U.S. PATENT DOCUMENTS

| | | | | |
|---|---|---|---|---|
| 5,269,631 | A * | 12/1993 | Mercer | B29C 55/04 442/50 |
| 2009/0003941 | A1* | 1/2009 | Maggioni | B32B 5/028 405/302.7 |
| 2010/0247239 | A1* | 9/2010 | Maggioni | E01C 3/00 404/70 |
| 2012/0202005 | A1* | 8/2012 | Maggioni | B29C 55/14 428/114 |
| 2012/0208417 | A1* | 8/2012 | Worthington | B29C 48/05 156/244.15 |

FOREIGN PATENT DOCUMENTS

| | | | | |
|---|---|---|---|---|
| EP | 2489503 | A1 | 8/2012 | |
| GB | 1210354 | A | 10/1970 | |
| WO | WO-2019058113 | A1 * | 3/2019 | B29D 28/00 |

OTHER PUBLICATIONS

Written Opinion dated May 25, 2020 in corresponding International Application No. PCT/IB2020/051013, 6 pages.

* cited by examiner

MONOLITHIC RETICULAR STRUCTURE FOR GEO GRIDS

CROSS-REFERENCE TO RELATED APPLICATIONS

This application is a U.S. National Stage application of PCT/IB2020/051013 filed Feb. 10, 2020, pending, which claims priority to U.S. Provisional Applications No. 62/804,274 filed Feb. 12, 2019, the entire disclosures of which are hereby incorporated by reference.

FIELD OF THE INVENTION

The present invention relates to a reticular structure for geotechnical applications usable for containing and/or draining the soil. The reticular structure can also be used to reinforce and/or consolidate soils, namely natural and artificial structures, for example slopes, green walls, block walls, sound absorbing barriers, rockfall barriers and railway roadbeds, roadbeds and parking areas. The present invention further relates to a method for manufacturing said reticular structure and a use of the same.

STATE OF THE ART

As is well known, reticular elements are available on the market that are used to reinforce, contain and/or consolidate the soil. In particular, so-called geogrids, monoaxially or biaxially oriented, made with high density polymers, are widely used in the geotechnical sector.

Geogrids can be obtained by the (mono-directional or bi-directional) stretching of a starting semi-finished product consisting of a uniplanar plate with constant thickness, extruded and subsequently holed. These geogrids have a uniplanar reticular structure in which it is possible to visibly identify longitudinal and transverse elements mutually intersecting at nodes where, in view of the process for forming the holed plate, the material forming the longitudinal elements is indistinguishable and in communion with the one forming the transverse elements. These geogrids are, for example, described in the following patents: U.S. Pat. No. 5,419,659A, US 2004062615A1, U.S. Pat. Nos. 3,386,876, 7,407,699B2, 6,423,394B1.

Alternatively, the geogrids can be obtained by co-extrusion of a series of first and second elements joined together to define a monolithic grid. The co-extruded grid is then stretched along one or more directions to define a single-stretched or bi-stretched reticular structure. These co-extruded grids are for example described in U.S. Pat. Nos. 4,662,946A and 5,753,337A.

In recent years, geogrids have also been introduced with the purposes of increasing the confining capacity exercised by the grid with the soil, as described for example in U.S. Pat. Nos. 9,556,580 and 10,024,002, through wires having rectangular cross section wherein the thickness is greater than the width.

Known geogrids are chemically inert and have excellent tensile strength in the direction of the stretched elements. Moreover, the openings of the mesh defined by the reticular structure allow the soil to enter between the threadlike elements (longitudinal and transversal elements) which define the reticular structure itself ensuring the formation of a reinforced composite material. In particular, the reticular structures are able to absorb stresses and evenly redistribute them to the soil, assuring, in the final analysis, greater static strength and dynamic strength of the entire reinforced structure.

While known geogrids have met with considerable success in view of the tensile strength characteristics and the ability of being chemically inert, the Applicant has noted that these geogrids are not free of limitations and drawbacks. In fact, a significant characteristic of the geogrid that considerably affects containment and stabilisation capabilities pertains to the torsional rigidity of the reticular structure: the greater the torsional rigidity of the reticular structure, the greater the consolidation/reinforcement capabilities of the soil. In particular, the Applicant has noted that the integral geogrids known today belong to two categories. A first category comprising the grids manufactured according to the teachings of the U.S. Pat. No. 5,419,659A, US 2004062615A1, U.S. Pat. Nos. 3,386,876, 7,407,699B2, 6,423,394B1 which, although they are characterised by a high tensile strength (obtainable by the stretching action) have poor torsional rigidity in relation to their weight and a limited ability to join (grip) the soil. A second category comprising the grids manufactured according to the teachings of the U.S. Pat. Nos. 4,662,946A, 9,556,580 and 10,024,002 which described geogrids having improved soil confinement characteristics, but poor torsional rigidity by effect of the wires with rectangular cross section.

PURPOSE OF THE INVENTION

A purpose of the present invention, therefore, is to solve substantially at least one of the drawbacks and/or limitations of the previous solutions.

A first objective of the present invention is to make available a reticular structure having high mechanical strength, in particular in terms of torsional and tensile strength, which can then correctly reinforce and consolidate the soil but which at the same time has excellent draining capabilities. A second objective is to make available a reticular structure having a high capacity of interaction and, concurrently, of confinement of the soil so as to perform an effective action reinforcing the soil itself. An additional purpose of the invention is to make available a reticular structure having low weight per unit of surface area, able to facilitate its manufacture, storage and installation. A further purpose of the invention is to make available a reticular structure obtainable with low production costs. Yet an additional objective is to obtain a reticular structure for geotechnical applications, capable of being easily applied and of adapting itself to any disposition inside the soil.

These purposes and yet others, which will become more readily apparent in the description that follows, are substantially achieved by a reticular structure and a method for its manufacture in accordance with one or more of the accompanying claims and/or of the following aspects.

SUMMARY

Aspects of the invention will be described in the following.

In a 1st aspect a monolithic reticular structure (2) made of plastic material for geotechnical applications is provided, said reticular structure (2) comprising:

- a plurality of first elements (3) distanced from each other and having an elongated conformation according to a first prevalent development path (T1),
- a plurality of second elements (4) distanced from each other and having an elongated conformation according to a second prevalent development path (T2), transverse, optionally orthogonal, to the first prevalent development path (T1) of the first elements (3), wherein said first and second elements (3, 4) intersect at nodes (5) to form meshes (6).

In a further aspect according to the preceding aspect the first elements (3) have, at least at a mid-portion defined between two nodes (5) immediately consecutive with respect to an orthogonal plane to the first prevalent development path (T1), a substantially T-shaped section comprising:

at least one elongated base (3*a*) extending along a direction of development (D1), at least one elongated protuberance (3*b*) emerging transversally, optionally orthogonally, from the base (3*a*).

In a further aspect according to any one of the preceding aspects the second elements (4) have, at least at a mid-portion defined between two nodes (5) immediately consecutive with respect to an orthogonal plane to the second prevalent development path, at least one respective elongated base (4*a*) extending along a respective direction of development (D2).

In a further aspect according to any one of the preceding aspects the bases (3*a*, 4*a*) respectively of the first and second elements (3, 4) are directly joined in a single piece to define a single bottom surface (2*a*) of the reticular structure (2).

In a further aspect according to any one of the preceding aspects the bottom surface (2*a*), defined by the bases (3*a*, 4*a*) respectively of the first and second elements (3, 4), is defined to the opposite side with respect to the protuberance (3*b*) of the first elements (3).

In a further aspect according to any one of the preceding aspects the bottom surface of the reticular structure have a substantially planar conformation.

In a further aspect according to any one of the preceding aspects the direction of development (D1) of the base (3*a*) of the first elements (3) is transverse, optionally orthogonal, and incident to the direction of development (D2) of the base (4*a*) of the second elements (4*a*).

In a further aspect according to any one of the preceding aspects each of said second elements (4) have, at least at a mid-portion defined between two nodes (5) immediately consecutive and with respect to a plane orthogonal to the second prevalent development path (T2), a substantially T-shaped section comprising:

the base (4*a*), at least a respective elongated protuberance (4*b*) emerging substantially orthogonally from the base (4*a*) of said second element.

In a further aspect according to any one of the preceding aspects the protuberances (3*b*, 4*b*) respectively of the first and second elements (3, 4) emerge from the respective bases (3*a*, 4*a*) from a same side of the reticular structure (2).

In a further aspect according to any one of the preceding aspects the first elements (3) have, along their entire development, a substantially constant T-section having T-shape.

In a further aspect according to any one of the preceding aspects the second elements (4) have, along their entire development, a substantially constant T-section having T-shape.

In a further aspect according to any one of the preceding aspects the protuberances (3*b*) of the first elements (3) intersect, at the nodes (5), with the protuberances (4*b*) of the second elements (4).

In a further aspect according to any one of the preceding aspects the T-shaped section of each of the first elements (3) consists exclusively of the base (3*a*) and the protuberance (3*b*).

In a further aspect according to any one of the preceding aspects the elongated base (3*a*) of each of said first elements (3), at least at a mid-portion defined between two immediately consecutive nodes (5), has a prefixed width ($W_{s1}$) measured along the direction of development (D1) of the same base (3*a*), wherein the protuberance (3*b*) of each of said first elements (3) has, at the mid-portion defined between two immediately consecutive nodes (5), a respective width ($W_{T1}$) always measured along the direction of development (D1) of the same base (3*a*), smaller than the width ($W_{s1}$) of the base of the first elements (3).

In a further aspect according to any one of the preceding aspects the ratio between the width ($W_{s1}$) of the base (3*a*) and the width ($W_{T1}$) of the protuberance (3*b*) pf the first elements is greater than 1.5, optionally comprised between 2 and 8.

In a further aspect according to any one of the preceding aspects the base (3*a*) of each first element (3) has substantially rectangular shape, wherein the width ($W_{S1}$) of the base (3*a*) is defined by the maximum distance between the short sides defining the rectangular shape of the base (3*a*) of said first elements (3).

In a further aspect according to any one of the preceding aspects the protuberance (3*b*) of each first element (3) also has a substantially rectangular shape extending prevalently along a transverse direction, optionally orthogonal, to the direction of development of the base (3*a*), wherein the maximum width ($W_{T1}$) of the protuberance (3*b*) is defined by the maximum distance between the long sides of the rectangular shape defining the protuberance (3*b*).

In a further aspect according to any one of the preceding aspects the T-shaped section of each first element (3), at a mid-portion defined between two immediately consecutive nodes (5), has a height ($H_{S1}$), measured orthogonally to the direction of development of the base (3*a*), wherein the ratio between the height ($H_{S1}$) of a first element (3) and the width ($W_{S1}$) of the base (3*a*) of the same first element (3) is greater than 0.5, optionally comprised between 0.6 and 5, still more optionally between 0.7 and 3.

In a further aspect according to any one of the preceding aspects the ratio between the width ($W_{S1}$) of the base (3*a*) of a first element (3) and the minimum distance ($W_{M1}$) between said first element and a first adjacent element is greater than 0.1, optionally equal to or greater than 0.12, still more optionally between 0.12 and 0.5.

In a further aspect according to any one of the preceding aspects the width ($W_{S1}$) of the base (3*a*) of a first element defines the maximum width of the first element (3) itself which is comprised between 1 mm and 10 mm, optionally between 3 mm and 6 mm.

In a further aspect according to any one of the preceding aspects the height ($H_{S1}$) of a first element (3) is greater than 1 mm, optionally between 1.5 mm and 9 mm, still more optionally between 2 mm and 8 mm.

In a further aspect according to any one of the preceding aspects the first elements (3) are mutually parallel, optionally the development paths (T1) of the first elements (3) are mutually parallel.

In a further aspect according to any one of the preceding aspects the base (3*a*) of the first elements (3) has a height ($H_{3A}$), measured orthogonally to the direction of development (D1) of the base (3*a*) of the first element, smaller than a height ($H_{3B}$) of the protuberance (3*b*) of the same first element always measured orthogonally to the direction of development (D1) of the base (3*a*).

In a further aspect according to any one of the preceding aspects the height ($H_{3A}$) of the base (3*a*) of the first elements (3) is between 0.5 mm and 5 mm, optionally between 1 mm and 3 mm.

In a further aspect according to any one of the preceding aspects the height ($H_{3B}$) of the protuberance (3*b*) of the first elements (3) is between 1 mm and 8 mm, optionally between 2 mm and 5 mm.

In a further aspect according to any one of the preceding aspects the ratio between the height ($H_{3B}$) of the protuberance (3*b*) of the first elements (3) and the height ($H_{3A}$) of the base (3*a*) of the first elements (3) is greater than 1.2, optionally it is between 1.2 and 15.

In a further aspect according to any one of the preceding aspects the ratio between the height ($H_{3B}$) of the protuberance (3*b*) of the first elements (3) and the width ($W_{S1}$) of the base (3*a*) of the first elements is between 0.5 and 2, optionally it is between 0.6 and 1.5.

In a further aspect according to any one of the preceding aspects the height ($H_{S1}$) of the first elements is defined by the sum of the heights of the base (3*a*) and the height of the protuberance (3*b*) of the first element (3).

In a further aspect according to any one of the preceding aspects the minimum distance ($W_{M1}$) between two first immediately adjacent elements (3) is between 20 mm and 80 mm, optionally between 30 mm and 50 mm.

In a further aspect according to any one of the preceding aspects the T-shaped section of each of the second elements (4) consists exclusively of the base (4*a*) and the protuberance (4*b*) of said second elements.

In a further aspect according to any one of the preceding aspects the elongated base (4*a*) of each of said second elements (4), at a mid-portion defined between two immediately consecutive nodes (5), has a prefixed width ($W_{s2}$) measured along the direction of development (D2) of the same base (4*a*), wherein the protuberance (4*b*) of each of said second elements (4) has, at the mid-portion defined between two immediately consecutive nodes (5), a respective width ($W_{T2}$) measured along the direction of development (D2) of the base (4*a*) of the same second element, smaller than the width ($W_{s2}$) of the base of the base (4*a*) of the same second element (4).

In a further aspect according to any one of the preceding aspects the ratio between the width ($W_{s2}$) of the base (4*a*) of each second element (4) and the width ($W_{T2}$) of the protuberance (4*b*) of each second elements (4) is greater than 1.5, optionally comprised between 2 and 8.

In a further aspect according to any one of the preceding aspects the base (4*a*) of each second element (4) has substantially rectangular shape, wherein the width ($W_{S2}$) of the base (4*a*) of each second element is defined by the maximum distance between the short sides defining the rectangular shape of said base (4*a*) of the respective second element (4).

In a further aspect according to any one of the preceding aspects the protuberance (4*b*) of each second element (4) has a substantially rectangular shape extending prevalently along a transverse direction, optionally orthogonal direction, to the direction of development of the base (4*a*), wherein the width ($W_{T2}$) of the protuberance (4*b*) of the second elements is defined by the maximum distance between the long sides of the rectangular shape defining the protuberance (4*b*).

In a further aspect according to any one of the preceding aspects the T-shaped section of each second element (4), at a mid-portion defined between two immediately consecutive nodes (5), has a height ($H_{S2}$), measured orthogonally to the direction of development of the base (4*a*) of the second elements (4), wherein the ratio between the height ($H_{S2}$) of a second element (4) and the width ($W_{S2}$) of the base (4*a*) of the same second element (4) is greater than 0.5, optionally between 0.6 and 5, still more optionally between 0.7 and 3.

In a further aspect according to any one of the preceding aspects the ratio between the width ($W_{S2}$) of the base (4*a*) of a second element (4) and the minimum distance ($W_{M2}$) between said second element (4) and a second adjacent element is greater than 0.1, optionally equal to or greater than 0.12, still more optionally between 0.12 and 0.5.

In a further aspect according to any one of the preceding aspects the width ($W_{S2}$) of the base (4*a*) of the second elements (4) defines the maximum width of said second element (4) which is comprised between 1 mm and 10 mm, optionally between 3 mm and 6 mm.

In a further aspect according to any one of the preceding aspects the height ($H_{S2}$) of a second element (4) is greater than 1 mm, optionally comprised between 1.5 mm and 9 mm, still more optionally between 2 mm and 8 mm.

In a further aspect according to any one of the preceding aspects the second elements (4) are mutually parallel, optionally the second prevalent development paths (T2) of the second elements are mutually parallel.

In a further aspect according to any one of the preceding aspects the base (4*a*) of each second element (4) has a height ($H_{4A}$), measured orthogonally to the direction of development (D2) of the base (4*a*) of the second element (4), smaller than a height ($H_{4B}$) of the protuberance (4*b*) of the same second element (4), always measured orthogonally to the direction of development (D2) of said base (4*a*).

In a further aspect according to any one of the preceding aspects the height ($H_{4A}$) of the base (4*a*) of the second elements (4) is comprised between 0.5 mm and 5 mm, optionally between 1 mm and 3 mm.

In a further aspect according to any one of the preceding aspects the height ($H_{4B}$) of the protuberance (4*a*) of the second elements (4) is comprised between 1 mm and 8 mm, optionally between 2 mm and 5 mm.

In a further aspect according to any one of the preceding aspects the ratio between the height ($H_{4B}$) of the protuberance (4*a*) and the height ($H_{4A}$) of the base (4*a*) of each of the second element (4) is greater than 1.2, optionally it is comprised between 1.2 and 15.

In a further aspect according to any one of the preceding aspects the ratio between the height ($H_{4B}$) of the protuberance (4*b*) of each of second element (4) and the width ($W_{S2}$) of the base (4*a*) of the same second elements (4) is comprised between 0.5 and 2, optionally it is comprised between 0.6 and 1.5.

In a further aspect according to any one of the preceding aspects the height ($H_{S2}$) of a second element is defined by the sum of the heights of the base and of the protuberance of the same second element (4).

In a further aspect according to any one of the preceding aspects the minimum distance ($W_{M2}$) between two second immediately adjacent second elements (4) is comprised between 20 mm and 80 mm, optionally between 30 mm and 50 mm.

In a further aspect according to any one of the preceding aspects the ratio between the width ($W_{S1}$) of the base (3*a*) of the first elements (3), optionally the width of the first elements (3), and the width ($W_{S2}$) of the base (4*a*) of the second elements (4), optionally the width of the second elements, is comprised between 0.5 and 2, optionally between 0.8 and 1.2.

In a further aspect according to any one of the preceding aspects the ratio between the height ($H_{S1}$) of the first elements (3) and the height ($H_{S2}$) of the second elements (4) is comprise between 0.5 and 2, optionally between 0.8 and 1.2.

In a further aspect according to any one of the preceding aspects the ratio between the distance between two first adjacent elements and the distance between two second adjacent elements is comprise between 0.5 and 2, optionally between 0.8 and 1.2.

In a further aspect according to any one of the preceding aspects the first elements are substantially identical to the second elements.

In a further aspect according to any one of the preceding aspects the first elements (3) are identical in shape to the second elements (4).

In a further aspect according to any one of the preceding aspects the first elements are substantially identical in size to the second elements.

In a further aspect according to any one of the preceding aspects the reticular structure comprises meshes having quadrilateral shape.

In a further aspect according to any one of the preceding aspects the reticular structure comprises meshes having squared or rectangular shape.

In a further aspect according to any one of the preceding aspects the first elements (3) are stretched along their development, wherein the stretch ratio of a first element (3) is defined as the ratio between a final length of the same element once the stretch is carried out and the initial length of said first element before the stretching action.

In a further aspect according to any one of the preceding aspects the first and second elements (3, 4) are obtained by the stretch of a semi-finished reticular structure having first and second precursor elements intersecting at nodes defining the meshes.

In a further aspect according to any one of the preceding aspects, the semi-finished reticular structure is obtained by means of:

a co-extrusion process, or extrusion of a solid slab subsequently cut.

In a further aspect according to any one of the preceding aspects said first elements (3) and/or said second elements (4) have a solid cross section.

In a further aspect according to any one of the preceding aspects the ratio between an area of a transversal cross section of a first element (3), measured at a portion intermediated between two immediately consecutive nodes (5), and a surface area of a transversal cross section of a second element (4), also measured at a portion intermediated between two immediately consecutive nodes (5), is comprised between 0.2 and 5, optionally between 0.3 and 4.

In a further aspect according to any one of the preceding aspects said first elements (3) have a transversal cross section, measured at a mid-portion defined between two immediately consecutive nodes, with surface area greater than 400 $mm^2$, optionally greater than 6400 $mm^2$.

In a further aspect according to any one of the preceding aspects the second elements (4) have a transversal cross section, measured at a mid-portion defined between two immediately consecutive nodes, with surface area greater than 400 $mm^2$, optionally greater than 6400 $mm^2$.

In a further aspect according to any one of the preceding aspects the first elements (3) have a stretch ratio greater than 3, optionally comprised between 3 and 8, more optionally between 4 and 7, the stretch ratio of the first elements is defined as the ratio between a final length of the first elements after a stretching action thereof and an initial length of the first elements before stretching.

In a further aspect according to any one of the preceding aspects the second elements (4) have a stretch ratio greater than 3, optionally comprised between 3 and 8, more optionally between 4 and 7, the stretch ratio of the second elements is defined as the ratio between a final length of the second elements after a stretching action thereof and an initial length of the second elements before stretching.

In a further aspect according to any one of the preceding aspects the reticular structure comprises at least a filtering element (18) engaged to at least one between said first and second elements (3, 4), said filtering element (18) defining, in cooperation with each mesh (6) defined by the first and the second elements (3, 4), a seat configured to receive gravel and/or rubble.

In a further aspect according to any one of the preceding aspects the filtering element (18) is stably constrained at a top portion of a plurality of protuberances (3*b*) of the first elements (3), opposed to the base (3*a*) of said first elements (3).

In a further aspect according to any one of the preceding aspects the filtering element (18) is stably constrained at a top portion of a plurality of protuberances (4*b*) of the second elements (4), opposed to the base (4*a*) of said second elements (4).

In a further aspect according to any one of the preceding aspects the filtering element (18) comprises a body made of sheet material, optionally having a planar structure.

In a further aspect according to any one of the preceding aspects the filtering element (18) comprises one or more sheets of non-woven material.

In a further aspect, a method for the manufacturing of a reticular structure according to any of the preceding aspects is provided, the method comprising the phases of:

forming a monolithic semi-finished product with a reticular structure having first elements and second precursor bodies of elongated shape and extending along respective prevalent development paths transversal, optionally orthogonal, one to the other, the first and second precursor choruses intersecting at nodes forming the meshes, stretching the semi-finished product along the development of the first and/or second precursor bodies so as to define said first and second elements (3, 4) of the reticular structure.

In a further aspect according to any one of the preceding aspects, the semi-finished product is obtained continuously by a co-extrusion process.

In a further aspect according to any of the preceding aspects, at least one of the first and second precursor bodies have, with respect to a plane orthogonal to the path of development of the precursor body, a section with a substantially "T" shape.

In a further aspect according to any one of the preceding aspects, the stretching phase is performed along the development of the first and second precursor bodies to define a bi-stretched reticular structure.

In a further aspect according to any of the preceding aspects, the method comprises, followed by the stretching phase, the constraining of the filtering element (18) to the first and/or second elements (3, 4).

In a further aspect according to any one of the preceding aspects the method the filtering element is stably constrained to the first and/or second elements by a rolling process.

In an additional aspect a use of the reticular structure is provided according to any one of the preceding aspects in a method for the consolidation and/or reinforcement of: soil or natural or artificial structures.

In an additional aspect according to any one of the previous aspects the reticular structure according to any one of the previous aspects is used in a method for the consolidation and/or reinforcement of at least one of: slopes, green walls, block walls, sound absorbing barriers, rockfall barriers, railway roadbeds, roadbeds and parking areas.

In a further aspect a natural or artificial structure is provided, including:

- a lower layer of soil,
- an intermediate layer made for a preponderant wall made of gravel and/or rubble,
- an exposed superficial layer, wherein the intermediate layer is interposed between the lower layer and the exposed superficial layer,
- at least one reticular structure (2) according to any one of the preceding aspects, said reticular structure being disposed at least partially within the intermediate layer.

In a further aspect according to the previous aspect the reticular structure (2) has the bases (3*a*) of the first elements (3) facing towards the exposed superficial layer while the protuberances (3*b*) of said first elements are facing towards the lower layer.

In a further aspect according to any one of the preceding aspects, the intermediate layer comprises the gravel and/or the rubble of the intermediate layer having a grain size equal to or greater than 2 mm, optionally comprised between 2 mm and 30 mm.

In a further aspect according to any one of the preceding aspects, at least part of the gravel and/or rubble of the intermediate layer is engaged within the meshes (6) of the reticular structure (2).

In a further aspect according to any one of the preceding aspects the lower layer comprises soil having a smaller grain size than the gravel and/or the rubble of the intermediate layer.

In a further aspect according to any one of the preceding aspects, the lower layer comprises at least one of: sand, loam, clay.

In a further aspect according to any one of the preceding aspects the reticular structure (2) comprises the at least one filtering element (18) facing towards the lower layer.

In a further aspect according to any one of the preceding aspects the filtering element (18) is configured to prevent the material composing the lower layer to reach the meshes (6) of the reticular structure (2).

BRIEF DESCRIPTION OF THE DRAWINGS

Some embodiments and some aspects of the invention shall be described hereafter with reference to the accompanying drawings, provided for indicative purposes only and therefore not limiting, wherein.

DEFINITIONS AND CONVENTIONS

Figure 1:
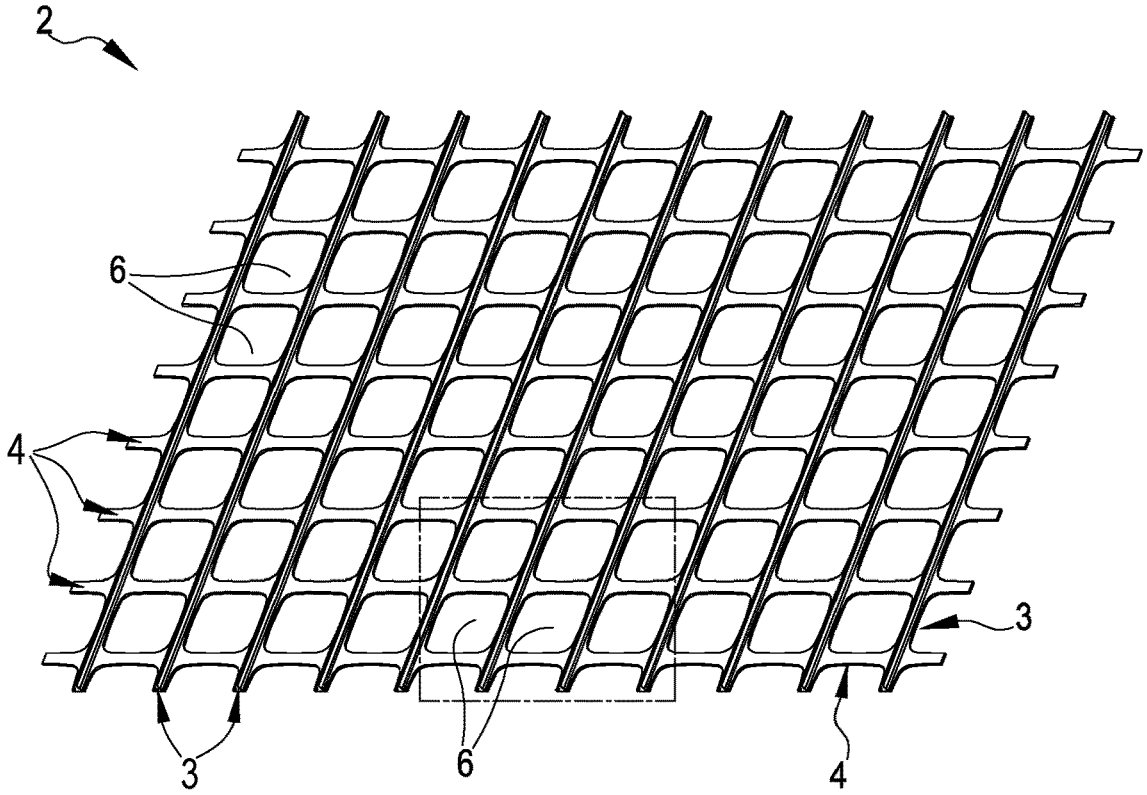
FIG. 1 is a perspective view of a reticular structure according to the invention.

It should be noted that in the present detailed description corresponding parts illustrated in the various figures are indicated with the same numerical references. The figures could illustrate the object of the invention through representations not to scale; therefore, parts and components illustrated in the figures relating to the object of the invention could pertain exclusively to schematic representations.

In the description that follows and in the claims the term "machine direction" refers to the movement of a starting semi-finished product formed by an extrusion station and that proceeds along a path of advance through a cooling station, optionally a stretching station and hence to a collecting station.

The term "torsional rigidity" (also called torsional modulus or torsional stability) means the resistance of a reticular structure to twist under the action of a force; torsional rigidity corresponds to the torque (in N*m) which must be applied to a geogrid to obtain the rotation by 1°. Torsional rigidity is measured in N*m/deg according to the method expressed in the ASTM D7864 standard.

DETAILED DESCRIPTION

Reticular Structure

The number 2 globally indicates a reticular structure for geotechnical applications. The reticular structure 2 comprises a plurality of first elements 3 distanced and mutually parallel; the first elements 3 are interconnected to a plurality of second elements 4 also distanced and mutually parallel: the plurality of second elements 4 are arranged transversely, in particular orthogonally, to the first elements 3. In detail, each of the first elements 3 extends along the entire reticular structure 2 and it is formed by a plurality of portions aligned along a same line. Similarly, each of said second elements 4 also extends along the entire reticular structure 2, transversely to the first elements 3, and it is formed by a plurality of portions aligned along a same line: each of the first elements 3 is intersected by a plurality of second elements 4 and each of the second elements 4 is intersected by a plurality of first elements 3 at nodes 5 to form meshes 6.

The reticular structure 2 defines a grid (net) that is monolithic, i.e. in a single piece, consisting exclusively of said first and second elements; the reticular structure 2 is made of plastic material, for example, it is made using one or more of the following polymers: polyethylene, high density polyethylene (HDPE), polypropylene.

In detail, the first elements 3 have an elongated conformation according to a first prevalent development path T1. As shown in the accompanying figures, the paths T1 are mutually parallel to define a plurality of first mutually parallel elements 3.

Figure 2:
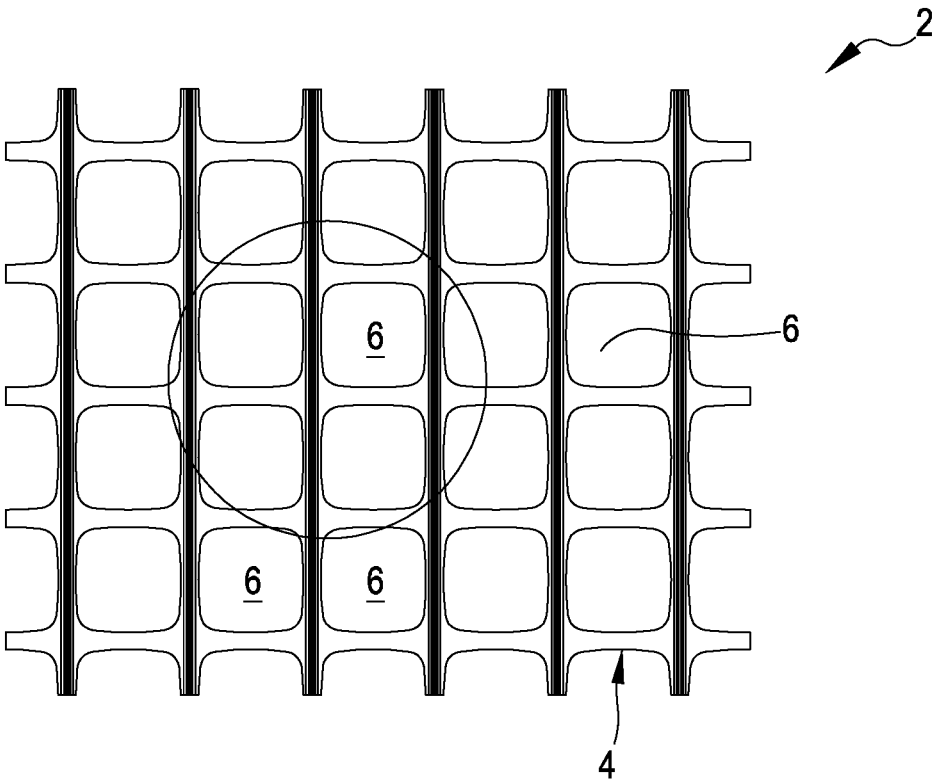
FIG. 2 is a top view of a reticular structure according to the invention.
Figure 2A:
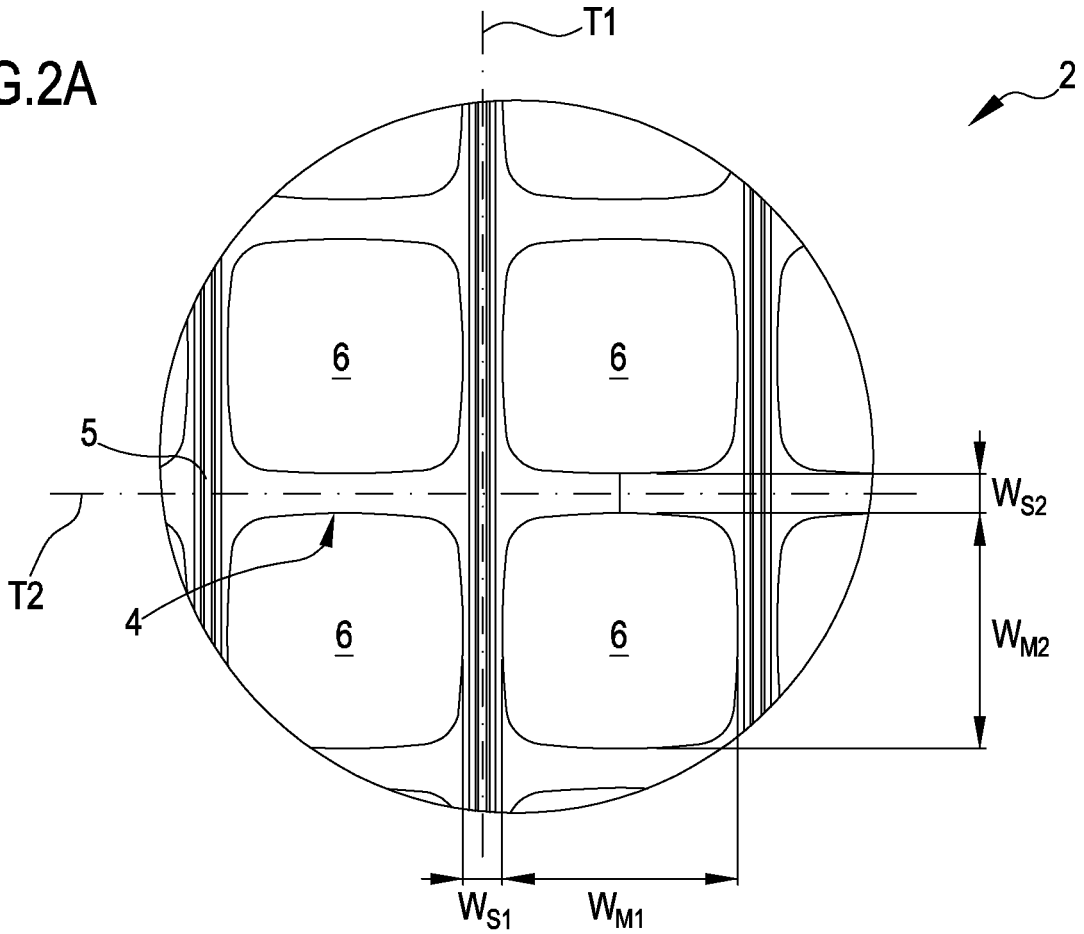
FIG. 2A is a detailed view of the reticular structure of FIG. 2.
Figure 3:
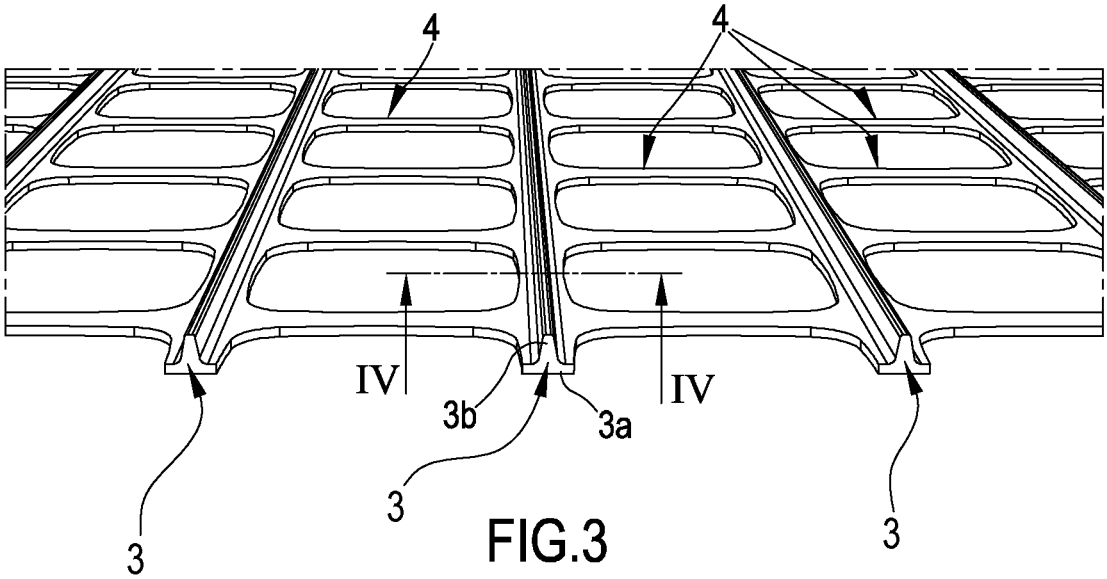
FIG. 3 is a perspective side view of a reticular structure according to the invention.
Figure 4:
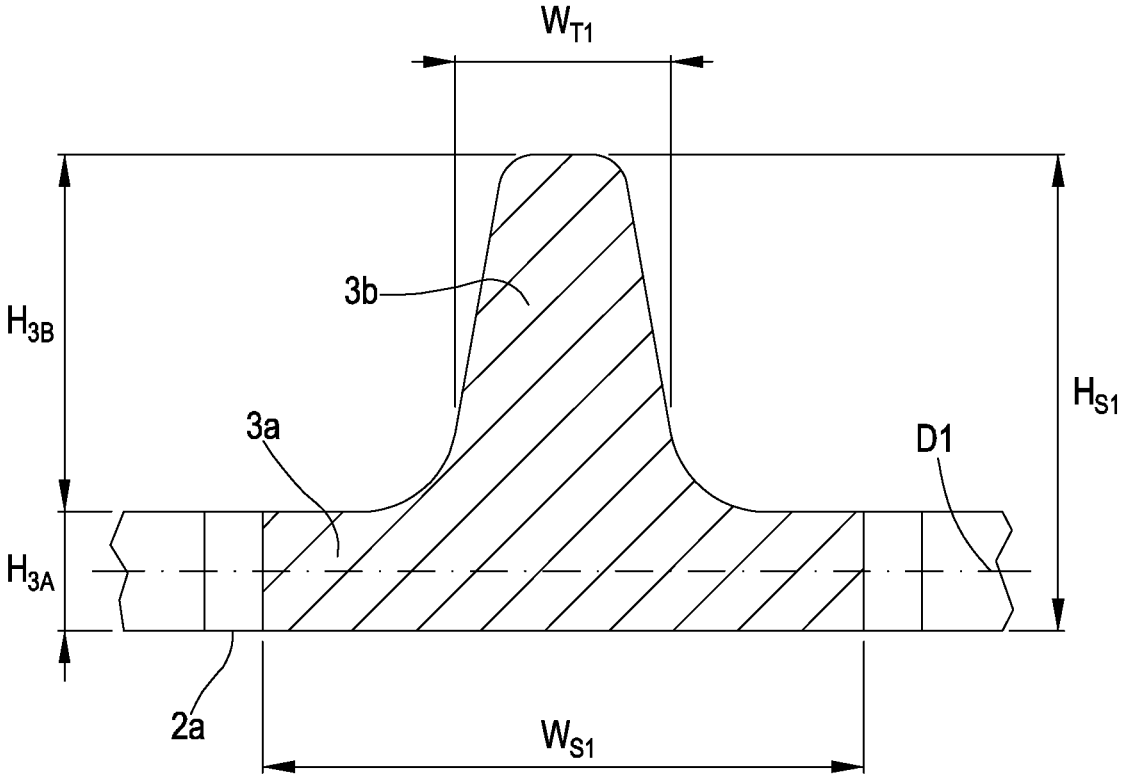
FIG. 4 is a section view, according to the line IV-IV, of the reticular structure of FIG. 2.
Figure 5:
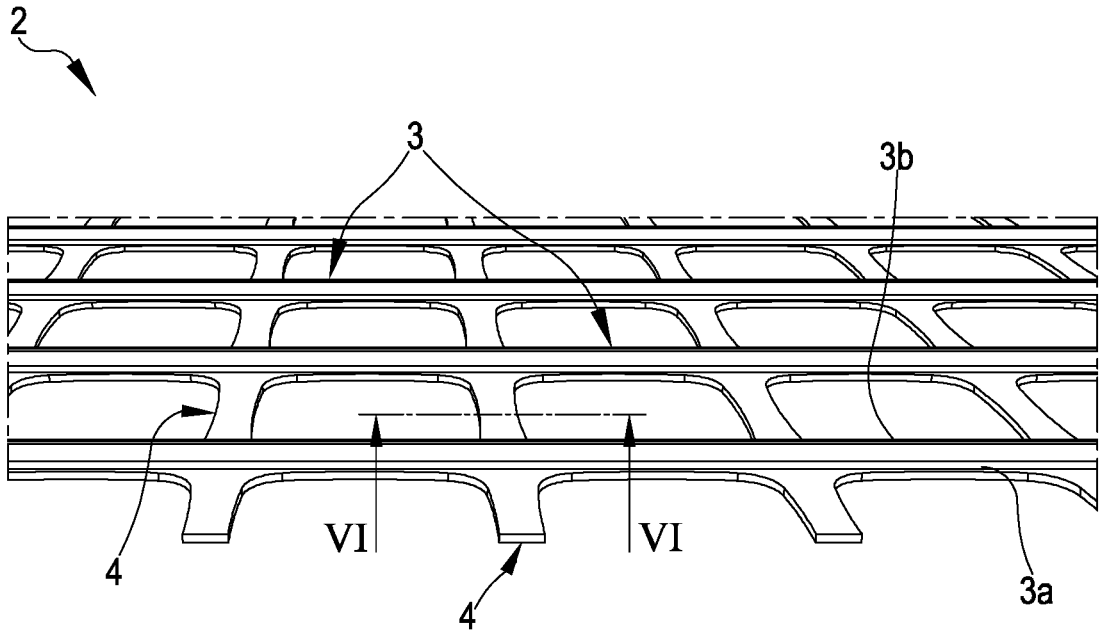
FIG. 5 is a perspective side view of a reticular structure according to the invention.
Figure 6:
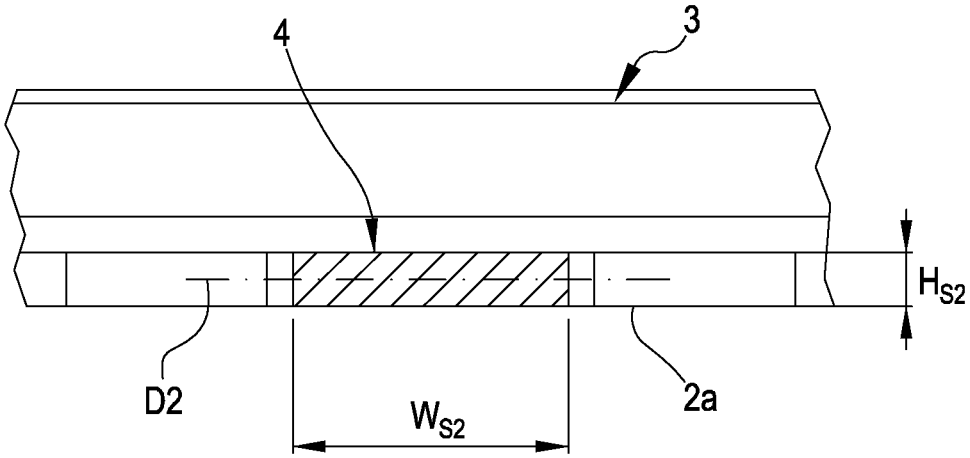
FIG. 6 is a section view, according to the line IV-IV, of the reticular structure of FIG. 2.

The first elements 3 have, at least at a mid-portion defined between two immediately consecutive nodes 5 and orthogonally to the first prevalent development path T1, a substantially T-shaped section comprising: at least one elongated base 3*a* extending along a direction of development D1 (see FIGS. 2A and 4), and at least one elongated protuberance 3*b* emerging substantially orthogonally from the base 3*a* (FIG. 4).

The T-section of the first elements 3 is defined at least at the intermediate portion defined between two consecutive nodes 5; in fact, the intermediate portion of a first element 3 comprises a mid-tract or point of said first element 3 positioned between two consecutive nodes 5. The T-section can however extend along the entire development of the first elements 3 as illustrated schematically in FIG. 1. Reference will be made below to the dimensions of the base 3*a* and of the protuberance 3*b* of the T-section of the first elements 3; these shapes and dimensions are referred to the section of said first elements 3 taken at said mid-portion. Since the T-section can, however, constantly extend along the entire development of said first elements 3, the shape and the dimensions of the T-shape of the first elements 3 (in particular of the base 3*a* and of the protuberance 3*b*) can refer to any cross section (tract) of said first elements 3.

As shown in FIG. 4, the elongated base 3*a* of each first element 3 has a rectangular shape developing prevalently along the direction D1. The protuberance 3*b* also has a substantially rectangular shape (optionally substantially trapezoidal) developing prevalently along a direction transverse (orthogonal) to the direction D1 of prevalent development of the base 3*a*. In detail, the protuberance emerges starting from a mid-portion of the base so as to define the section having T-shape.

In terms of dimensions, the base 3*a* has a prefixed width $W_{S1}$, measured along the direction of development D1 of the same base 3*a*, which is between 1 mm and 10 mm, optionally between 3 mm and 6 mm. The width $W_{S1}$ of the base 3*a* is essentially defined by the maximum distance between the short sides defining the rectangular shape of the base 3*a* (see FIG. 4). Concerning instead the height $H_{3A}$ or thickness of the base 3*a*, it is measured orthogonally to the direction of development D1, and it is between 0.5 mm and 5 mm, optionally between 1 mm and 3 mm.

The protuberance 3*b* has a respective width $W_{T1}$, also measured along the direction of development D1 of the base 3*a*, which is smaller than the width $W_{S1}$ of the base 3*a*; in detail, the width $W_{T1}$ of the protuberance 3*b* is between 0.5 mm and 5 mm, optionally between 1 mm and 3 mm. As shown in FIG. 4, the protuberance 3*b* can be joined to the base 3*a* by junction portions (radiused portions); the term width $W_{T1}$ of the protuberance means the maximum width of the protuberance 3*b* without taking into consideration said radiused junction portions. In fact, the width $W_{T1}$ is defined by the maximum distance of the long sides defining the rectangular shape of the protuberance 3*b*. The ratio between the width $W_{s1}$ of the base 3*a* and the width $W_{T1}$ of the protuberance 3*b* is greater than 1.5, optionally comprised between 2 and 8.

The protuberance 3*b* has a prefixed height $H_{3B}$ measured orthogonally to the direction of development D1 of the base 3*a*. The height $H_{3B}$ of the protuberance 3*b* of the first elements 3 is comprised between 1 mm and 8 mm, optionally between 2 mm and 5 mm. In fact, the height $H_{3B}$ of the protuberance 3*b* is greater than the height $H_{3A}$ of the base 3*a*; in detail, the ratio between the height $H_{3B}$ of the protuberance 3*a* of the first elements 3 and the height $H_{3A}$ of the base 3*a* of the first elements 3 is greater than 1.2, optionally it is between 1.2 and 15. The sum of the heights of the base 3*a* and of the protuberance 3*b* of the first elements defines a height $H_{S1}$ of the first elements 3. In fact, the height of the first elements 3 is defined as the maximum distance between a bottom surface 2*a* of the base 3*a* opposite the protuberance 3*b* and a top point of the protuberance 3*b*. The height $H_{S1}$ is comprised between 1.5 mm and 9 mm, optionally between 2 mm and 8 mm.

The ratio between the height $H_{S1}$ of a first element 3 and the width $W_{S1}$ of the base 3*a* of the same first element 3 is greater than 0.5, optionally comprised between 0.6 and 5, still more optionally between 0.7 and 3. The ratio between the width $W_{S1}$ of the base 3*a* of a first element 3 and the minimum distance $W_{M1}$ between said first element and a first adjacent element is greater than 0.1, optionally equal to or greater than 0.12, still more optionally comprised between 0.12 and 0.5; in which the minimum distance $W_{M1}$ between two first elements 3 immediately adjacent is comprised between 20 mm and 80 mm, optionally between 30 mm and 50 mm. With regard instead to the ratio the ratio between the height $H_{3B}$ of the protuberance 3*b* of the first elements 3 and the width $W_{S1}$ of the base 3*a* of the first elements is comprised between 0.5 and 2, optionally it is comprised between 0.6 and 1.5. Concerning instead the second elements 4, they also have an elongated conformation according to a second prevalent development path T2. As shown in the accompanying figures, the paths T2 are mutually parallel to define a plurality of second mutually parallel elements 4.

Figure 1A:
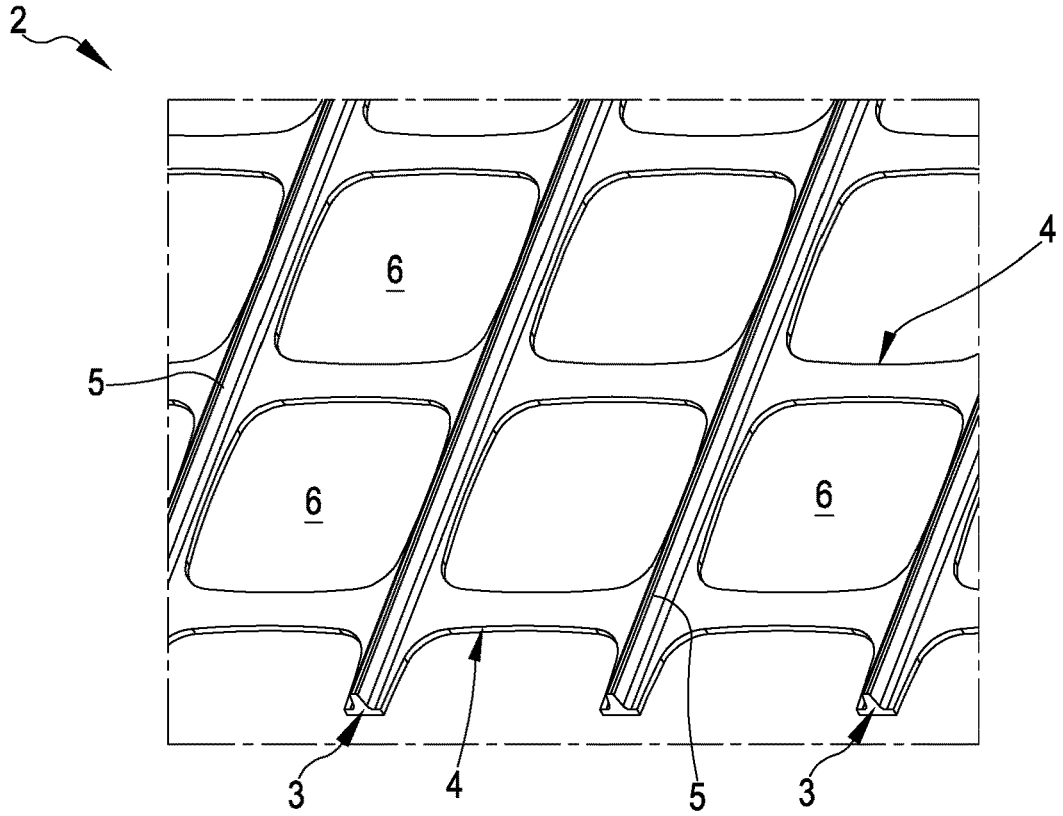
FIG. 1A is a detailed view of the reticular structure of FIG. 1.

In a first embodiment illustrated for example in figures from 1 to 3, the second elements 4 have, at least at a mid-portion defined between two immediately consecutive nodes 5 and orthogonally to the second prevalent development path, a respective elongated base 4*a* extending along a respective direction of development D2: the direction of development D1 of the base 3*a* of the first elements 3 is transverse, optionally orthogonal, and incident to the direction of development D2 of the base 4*a* of the second elements 4. The base 4*a* of the second elements also has a rectangular shape that intersects with the rectangular shape of the base 3*a* of the first elements 3 as shown in FIG. 1A.

As shown in the accompanying figures, the bases 3*a*, 4*a* respectively of the first and second elements 3, 4 lie substantially on a same plane: the bases 3*a*, 4*a* respectively of the first and second elements 3, 4 essentially define a single bottom surface 2*a* of the reticular structure 2 having a substantially planar conformation.

Figure 7:
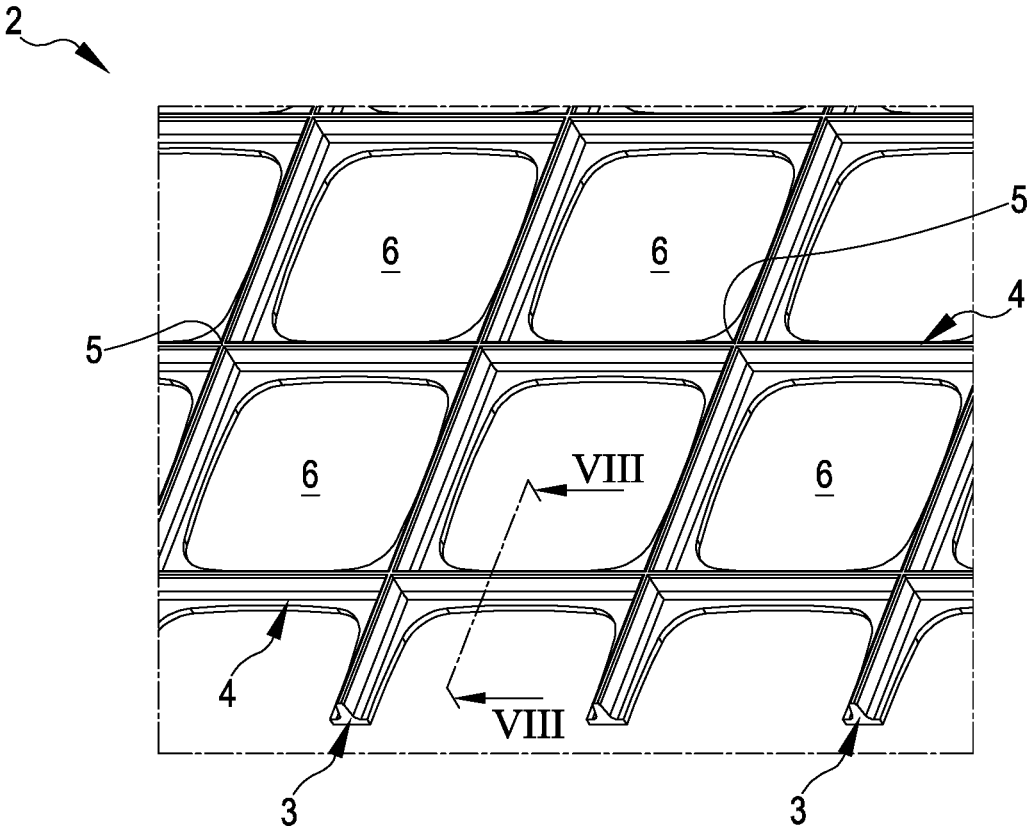
FIG. 7 is a perspective view of an additional embodiment of a reticular structure according to the invention.
Figure 8:
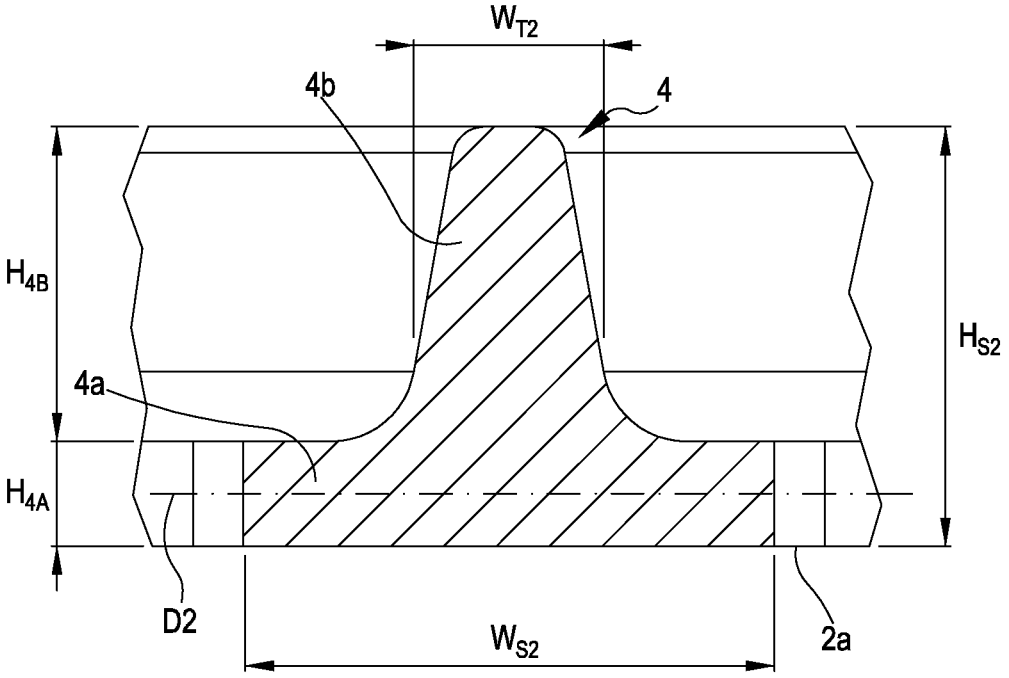
FIG. 8 is a section view, according to the line IV-IV, of the reticular structure of FIG. 7.

In a second embodiment shown in FIGS. 7 and 8, the second elements 4 have, at least at a mid-portion defined between two immediately consecutive nodes 5 and orthogonally to the second prevalent development path T2, a substantially T-shaped section comprising: the base 4*a* and at least one elongated protuberance 4*b* emerging substantially orthogonally from the base 4*a*. In this embodiment, the protuberances 3*b*, 4*b* of the first and second elements 3, 4 emerge from the respective bases 3*a*, 4*a* from a same side of the reticular structure 2. In fact, the reticular structure 2, in its second embodiment, has a bottom surface 2*a* from which emerge in height (thickness) the bases 3*a*, 4*a* and the protuberance 3*b*, 4*b*.

The T-section of the second elements 4 is defined at least at the intermediate portion defined between two consecutive nodes 5; in fact, the intermediate portion of a second element 4 comprises a mid-tract or point of said element 4 positioned between two consecutive nodes 5. The T-section can however extend along the entire development of the second elements 4 as illustrated schematically in FIG. 7; in this configuration, the bases and the protuberances 3*b* of the first elements 3 intersect, at the nodes 5, with the bases 4*a* and protuberances 4*b* of the second elements 4.

In the following, reference will be made to the dimensions of the base 4*a* and of the protuberance 4*b* of the second elements 4; these shapes and dimensions are referred to the section of said second elements 4 at said mid-portion. Since the T-section can, however, constantly extend along the entire development of said second elements 4, the shape and the dimensions of the T-shape of the second elements 4 (in particular of the base 4*a* and of the protuberance 4*b*) can refer to any cross section (tract) of said second elements 4.

As shown in FIG. 7, the elongated base 4*a* of each second element 4 has a rectangular shape developing prevalently along the direction D2. The protuberance 4*b* also has a substantially rectangular shape developing prevalently along a direction transverse (orthogonal) to the direction D2 of prevalent development of the base 4*a*. In detail, the protuberance emerges starting from a mid-portion of the base so as to define the section having T-shape.

In terms of dimensions, the base 4*a* has a prefixed width $W_{s2}$, measured along the direction of development D2 of the same base 4*a*, which is comprised between 1 mm and 10 mm, optionally between 3 mm and 6 mm. The width $W_{S2}$ of the base 4*a* is essentially defined by the maximum distance between the short sides defining the rectangular shape of the base 4*a* (see FIG. 8). Concerning instead the height $H_{4A}$ or thickness of the base 4*a*, it is measured orthogonally to the direction of development D2, and it is comprised between 0.5 mm and 5 mm, optionally between 1 mm and 3 mm.

The protuberance 4*b* has a respective width $W_{T2}$, also measured along the direction of development D2 of the base 4*a*, which is smaller than the width $W_{S2}$ of the base 4*a*; in detail, the width $W_{T2}$ of the protuberance 4*b* is comprised between 0.5 mm and 5 mm, optionally between 1 mm and 3 mm. As shown in FIG. 8, the protuberance 4*b* can be joined to the base 4*a* by junction portions (radiused portions); the term width $W_{T2}$ of the protuberance 4*b* means the maximum width of the protuberance 4*b* without taking into consideration said radiused junction portions. In fact, the width $W_{T2}$ is defined by the maximum distance of the long sides defining the rectangular shape of the protuberance 4*b*. The ratio between the width $W_{s2}$ of the base 4*a* and the width $W_{T2}$ of the protuberance 4*b* is greater than 1.5, optionally between 2 and 8.

The protuberance 4*b* has a prefixed height $H_{4B}$ measured orthogonally to the direction of development D2 of the base 4*a*. The height $H_{4B}$ of the protuberance 4*b* of the second elements 4 is comprised between 1 mm and 8 mm, optionally between 2 mm and 5 mm. In fact, the height $H_{4B}$ of the protuberance 4*b* is greater than the height $H_{4A}$ of the base 4*a*; in detail, the ratio between the height $H_{4B}$ of the protuberance 4*a* of the second elements 4 and the height $H_{4A}$ of the base 4*a* of the second elements 4 is greater than 1.2, optionally it is comprised between 1.2 and 15. The sum of the heights of the base 4*a* and of the protuberance 4*b* of the second elements defines a height $H_{S2}$ of the second elements 4. In fact, the height of the first elements 4 is defined as the maximum distance between a bottom surface of the base 2*a* opposite the protuberance 4*b* and a top point of the protuberance 4*b*. Said height $H_{S2}$ is comprised between 1.5 mm and 9 mm, optionally between 2 and 8 mm.

The ratio between the height $H_{S2}$ of a second element 4 and the width $W_{S2}$ of the base 4*a* of the same second element 4 is greater than 0.5, optionally comprised between 0.6 and 5, still more optionally between 0.7 and 3. The ratio between the width $W_{S2}$ of the base 4*a* of a second element 4 and the minimum distance $W_{M2}$ between said second element and a second adjacent element is greater than 0.1, optionally equal to or greater than 0.12, still more optionally comprised between 0.12 and 0.5; in which the minimum distance between two second elements 4 immediately adjacent $W_{M2}$ is between 20 mm and 80 mm, optionally between 30 mm and 50 mm. With regard instead to the ratio the ratio between the height $H_{4B}$ of the protuberance 4*b* of the second elements 4 and the width $W_{S2}$ of the base 4*a* of the second elements 4 is comprised between 0.5 and 2, optionally it is comprised between 0.6 and 1.5.

Some dimensional ratios of the first and second elements 3, 4 are provided below. The ratio between the width $W_{S1}$ of the base 3*a* of the first elements 3, optionally the width of the first elements 3, and the width $W_{S2}$ of the base 4*a* of the second elements 4, optionally the width of the second elements, is comprised between 0.5 and 2, optionally between 0.8 and 1.2. The ratio between the height $H_{S1}$ of the first elements 3 and the height $H_{S2}$ of the second elements 4 is comprised between 0.5 and 2, optionally between 0.8 and 1.2. The ratio between the distance between two first adjacent elements and the distance between two second adjacent elements is comprised between 0.5 and 2, optionally between 0.8 and 1.2.

In fact, in the first embodiment the second elements 4 are elements having substantially uniplanar conformation which are joined to the base 3*a* of the first elements. In the second embodiment, the second elements also have a T-shape and can be substantially identical, in shape and dimension, to the first elements 3.

In the various embodiments illustrated in the accompanying figures, the meshes 6 of the reticular structure are substantially squared. Obviously, it is possible to produce meshes having different shape, for example rectangular, triangular or rhomboidal. Quantitatively, the minimum distance $W_{M1}$ between two first adjacent elements 3 is comprised between 20 mm and 80 mm, optionally between 25 and 50 mm. Similarly, the distance $W_{M2}$ between second adjacent elements 4 is comprised between 20 mm and 80 mm, optionally between 25 mm and 50 mm. As these distances change, the dimensions of the meshes 6 change, which can have a through surface area between 400 and 6400 $mm^2$.

The reticular structure 2 is stretched at least a long a direction of extension of the first or of the second elements to define a single-stretched reticular structure 2; for example, the reticular structure 2 can be stretched along the development of the first elements 3 only. The reticular structure 2 can be stretched along two directions, in particular along the development of the first and of the second elements 3, 4 to define a bi-stretched reticular structure as shown for example in FIGS. 1 and 7.

The stretch ratio, i.e. the ratio between the length of the elements (first elements and/or second elements) after the stretch and their length before the stretch is greater than 2, optionally comprised between 3 and 10, still more optionally comprised between 4 and 8.

Although the reticular structure 2 has two directions of prevalent development (i.e. the directions in which the first and the second element extend), the structure 2 has a certain height, or total thickness, orthogonally to these directions of prevalent development so as to provide the structure 2 itself with a certain three-dimensionality which differentiates the structure 2 from uniplanar nets.

The height of the reticular structure 2 is defined by the (maximum) height of the first and/or of the second elements 3, 4. In the first embodiment, the height of the reticular structure is essentially defined by the height of the first elements having T-shape conformation while, in the second embodiment, the height is defined by the maximum height of the first and/or of the second elements which both have a T-shape conformation. It is useful to observe that the reticular structure is an essentially smooth bottom surface 2*a*, optionally flat, i.e. free of protuberances or ridges; at the opposite side the reticular structure 2 has a series of protuberances (elements 3*b* and/or 4*b*) or ridges that provides the structure with a certain three-dimensionality that allows the structure to be differentiated from known uniplanar geogrids obtained by a process of stretching of a uniplanar plate with constant thickness.

In the above description, first and/or second elements having "T" shaped transversal cross section have been described. However, it is possible to produce first elements 3 having substantially "L" shaped transversal cross section, also consisting of the base 3*a* and of the protuberance 3*b*. In addition, it is possible to produce first elements 3 having substantially "A" shaped transversal cross section, always consisting of the base 3*a* and of the protuberance 3*b*. In addition, it is possible to produce first elements 3 having substantially "V" shaped transversal cross section, always consisting of the base 3*a* and of the protuberance 3*b*. In addition, it is possible to produce first elements 3 having substantially "Y" shaped transversal cross section, always consisting of the base 3*a* and of the protuberance 3*b*. In addition, it is possible to produce first elements 3 having substantially "+" shaped always cross section, also consisting of the base 3*a* and having two protuberances 3*b* emerging from opposite sides of the base 3*a*.

In addition, it is possible to produce first elements 3 having a transversal cross section that is substantially equal to the combination of at least two of the profiles between "T", "L", "A", "V" or "Y" or "+", in which said transversal cross section consists of the base 3*a* and one or more protuberances 3*b*. As for the first elements, also the second elements 4 can have "L", "A", "V", "Y", "+" shaped transversal cross section or a combination thereof, also consisting of the base 4*a* and one or more protuberances 4*b*.

The reticular structure 2 thus obtained (monolithic structure made of plastic material) has a specific weight between 100 and 500 g per $m^2$ and a specific tensile strength, along the first and/or second stretched elements (the first and/or second elements 3, 4), greater than 8 KN/m, optionally between 12 and 40 KN/m, still more optionally between 15 and 30 KN/m. The specific tensile strength is measured with the method described in the standard ASTM D6637.

Thanks to the shape and to the dimensions of the first and second element 3, 4, and thanks to the process of stretching the reticular structure, the latter has torsional rigidity greater than 0.2 N*m/deg, optionally greater than 0.3 N*m/deg, still more optionally between 0.35 and 0.7 N*m/deg once measured according to the standard ASTM D7864-15.

Figure 9:
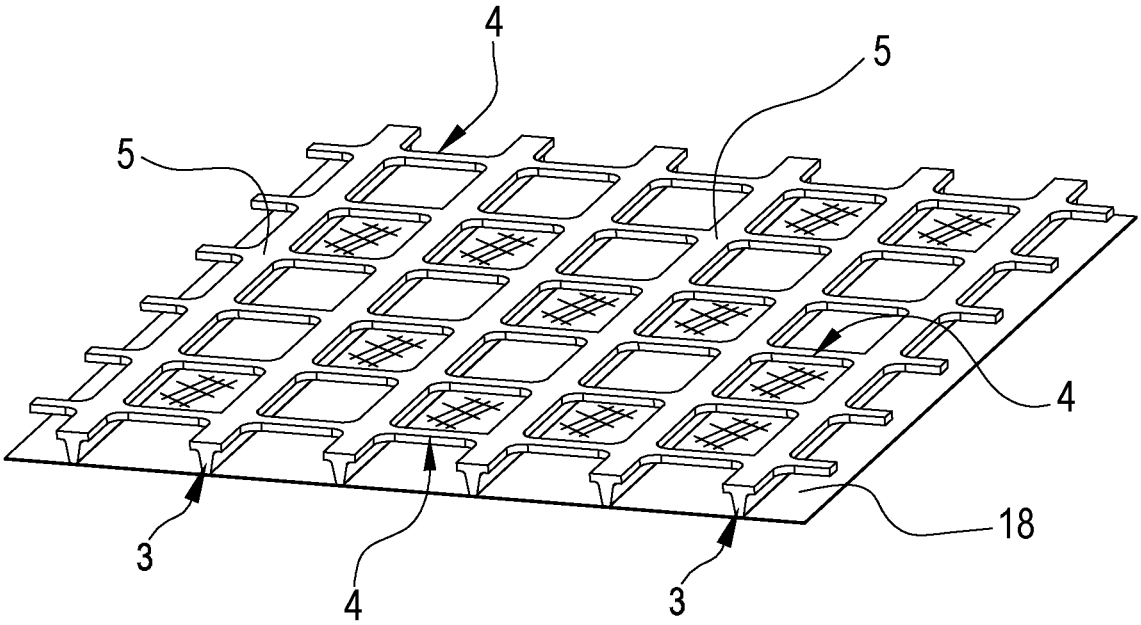
FIG. 9 is a schematic view of a reticular structure according to the present invention comprising a filtering element.
Figure 10:
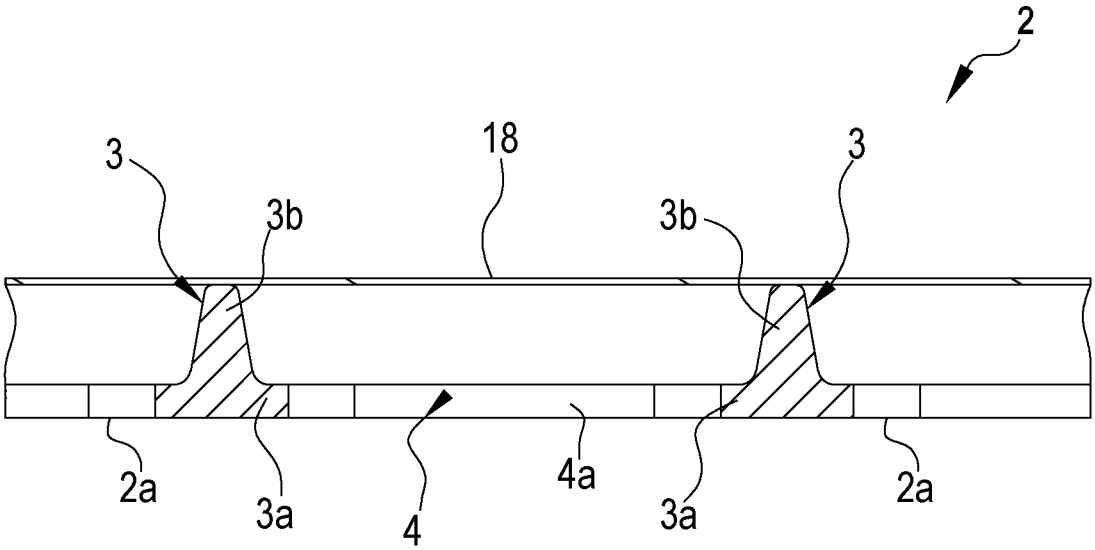
FIG. 10 is a detailed view of a section of the reticular structure shown in FIG. 9.
Figure 11:
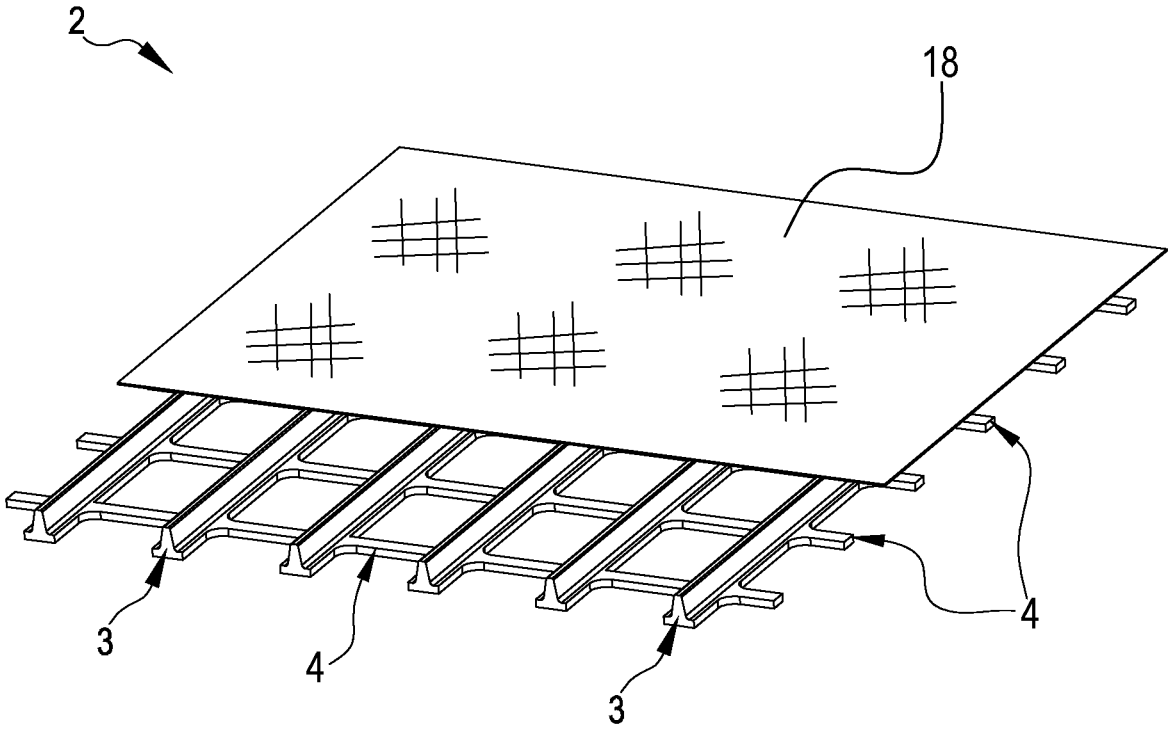
FIG. 11 is another perspective view of the reticular structure of FIG. 9.
Figure 12:
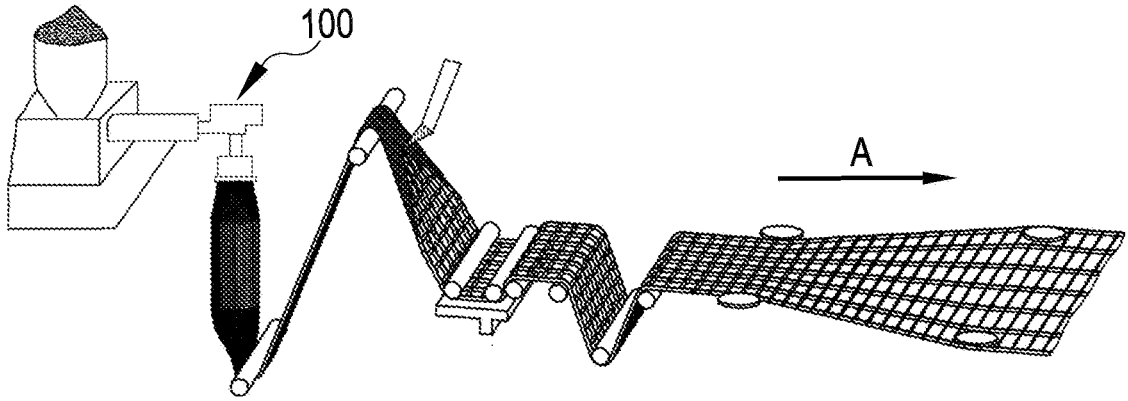
FIG. 12 is a schematic view illustrating a possible manufacturing process of the reticular structure according to the present invention.

As illustrated in FIGS. 9-11, the reticular structure 2 may comprise at least one filtering element 18 coupled, optionally fixed (welded, bonded or laminated), to the first and/or second elements 3, 4. In detail, the filtering element 18 is stably constrained to the first and/or second elements 3, 4 opposed to the base 3*a* of the first elements 3; in detail and as illustrated in FIG. 10, the filtering element 18 is engaged at a top portion of a plurality of protuberances 3*b* of the first elements 3 opposed to the base 3*a*. It is not excluded the possibility of engage the filtering element also to the second elements 4, for example at a top of a portion of a plurality of protuberances 4*b* of the second elements 4.

As shown in FIG. 9, the filtering element 18, in cooperation with each mesh 6—defined by first and second elements 3, 4—delimit a seat (or cells) configured to receive and stably engage gravel and/or rubble for proper reinforcement and/or consolidation of the soil. In fact, the filtering element 18 allows the full interlocking of the gravel or rubble with the reticular structure 2 such that the reticular structure 2 ensures, in cooperation with the gravel and rubble, the correct reinforcement/consolidation of the soil. It is useful to clarify how gravel and/or rubble play an important role in consolidation and reinforcement of the soil. In fact, gravel and/or rubble are "noble" materials, very often present in the natural and/or artificial structures to be reinforced, placed just below the superficial layer of the ground: thanks to their mechanical characteristics and natural drainage with respect to the ground, the gravel and/or the rubble allows to consolidate and/or reinforce the soil ensuring a longer lifetime of the entire natural and/or artificial structure.

Thanks to the introduction of the reticular structure 2, the latter is able to cooperate with the gravel and/or rubble layer to further improve the holding characteristics of the soil, thus increasing its consolidation and reinforcement. In detail, the reticular structure 2 can be positioned inside the gravel and/or crushed layer or at the base of said layer and at the interface between the latter and a lower layer characterized by less noble material with greater variability (fine materials with a reduced grain size, such as sand and clay).

In said condition, the filtering element 18 may be used to prevent the substrate material (e.g. fine soil, sand or clay) from migrating into the gravel or rubble and reducing its mechanical properties.

The filtering element 18 may also be used to allow the selective passage of material through the reticular structure 2. For example, the filtering element 18 may be configured to allow water to pass through the soil to ensure the correct drainage conditions.

The filtering element 18 may include a sheet material body, optionally having a substantially flat structure. In detail, the filtering element 18 comprises one or more sheets of non-woven material.

Manufacturing Method

The present invention also relates to a method for manufacturing a reticular structure 2 according to the above description and according to any of the accompanying claims.

The method comprises forming first and second elements 3, 4 through a process of coextrusion (concurrent extrusion of the first and of the second elements 3, 4). The coextrusion process, schematically shown in FIG. 9, comprises the concurrent extrusion of first and second precursor elements by means of an extrusion head 100; the first precursor elements are longitudinal elements that extend along the direction of advance of the plastic material exiting the head 100 while the second precursor elements are transverse elements to the first precursor elements: first and second precursor elements forming an integral monolithic reticular body.

The first precursor elements exiting the extrusion head have a substantially T-shaped cross section. The second precursor elements can have a rectangular section or a corresponding T-shaped section.

After the formation of the integral monolithic body, the latter can undergo a stretching process along the development of the first and/or second elements to define a single-stretch or bi-stretched reticular structure.

Following the stretching phase, the method may provide for a rolling phase of the stretched structure with filtering element 18 such that to stably constrain the latter to the first and/or second elements 3, 4 on the opposite side to the base 3*a* of the first elements 3.

The reticular structure is subsequently cut transversely to the first elements according to a prefixed length, measured in the direction of the first elements or longitudinal elements to define said reticular structure 2.

Additional production systems are possible and they are evident for the person skilled in the art of extrusion, for example starting from a flat extrusion head to produce a plate having on at least one face the protuberances 3*b* and/or 4*b* and that will then be subjected to the steps of cold holing and of stretching to obtain the described invention.

The invention claimed is:

1. A monolithic reticular structure made of plastic material for geotechnical applications, said reticular structure comprising:

a plurality of first elements distanced from each other and having an elongated conformation according to a first prevalent development path, and a plurality of second elements distanced from each other and having an elongated conformation according to a second prevalent development path, transverse to the first prevalent development path of the first elements, wherein said first and second elements intersect at nodes to form meshes, wherein the first elements have, at least at a mid-portion defined between two of the immediately consecutive nodes and with respect to a plane orthogonal to the first prevalent development path, a substantially T-shaped section comprising:

at least one elongated base extending along a direction of development, and at least one elongated protuberance emerging substantially orthogonally from a middle portion of the base, wherein the second elements have, at least at a mid-portion defined between two of the immediately consecutive nodes and with respect to a section orthogonal to the second prevalent development path, at least one respective elongated base extending along a respective direction of development, and wherein the first elements are stretched along their development, wherein the stretch ratio of the first element is defined as the ratio between a final length of the same first element once the stretch is carried out and the initial length of said first element before the stretch is carried out, wherein the first elements have a stretch ratio between 4 and 7, and wherein the second elements are stretched along their development, the stretch ratio of the second element being defined as the ratio between a final length of the second element after a stretching action thereof and an initial length of the second element before stretching, wherein the second elements have a stretch ratio between 4 and 7, and wherein the bases, respectively of the first and second elements, are joined in a single piece to define a single bottom surface of the reticular structure opposed to the protuberances of the first elements, and wherein the single bottom surface of the reticular structure, defined by the bases respectively of the first and second stretched elements, has a planar conformation.

2. The reticular structure according to claim 1, wherein the second elements have, at least at the mid-portion defined between two of the immediately consecutive nodes and with respect to a section orthogonal to the second prevalent development path, a substantially T-shaped section comprising:

the base, at least one elongated protuberance emerging substantially orthogonally from the base, and wherein the protuberances of the first and second elements emerge from the respective bases from a same side of the reticular structure.

3. The reticular structure according to claim 2, wherein the protuberances of the first elements intersect, at the nodes, with the protuberances of the second elements.

4. The reticular structure according to claim 2, wherein the base of each of said second elements, at the mid-portion defined between two of the immediately consecutive nodes, has a prefixed width measured transverse to the direction of development of the same base, and wherein the protuberance of each of said second elements has, at the mid-portion defined between two of the immediately consecutive nodes, a respective width measured transverse to the direction of development of the base of the second element, smaller than the width of the base of the second element, and wherein the ratio between the width of the base and the width of the protuberance of the second elements is between 2 and 8.

5. The reticular structure according to claim 4, wherein the T-shaped section of each second element, at the mid-portion defined between two of the immediately consecutive nodes, has a height, measured orthogonally to the direction of development of the base of the second elements, and wherein the ratio between the height of a respective one of the second elements and the width of the base of the same second element is between 0.7 and 3.

6. The reticular structure according to claim 4, wherein the elongated base, of each of said first elements, at the mid-portion defined between two of the immediately consecutive nodes, has a prefixed width measured transverse to the direction of development of the same base, wherein the protuberance, of each of said first elements has, at the mid-portion defined between two of the immediately consecutive nodes, a respective width measured transverse to the direction of development of the base of the first element, smaller than the width of the base of the first element, wherein the ratio between the width of the base of each of the first elements and the width of the protuberance of each of the first elements is between 2 and 8, and wherein the ratio between the width of the base of the first elements and the width of the base of the second elements is between 0.8 and 1.2.

7. The reticular structure according to claim 2, wherein the base of the second elements has a height, measured orthogonally to the direction of development of the base, smaller than a height of the protuberance of the same base measured orthogonally to the direction of development of the base, and wherein the ratio between the height of the protuberance and the height of the base of the second elements is greater than 1.2.

8. The reticular structure according to claim 1, wherein the elongated base, of each of said first elements, at the mid-portion defined between two of the immediately consecutive nodes, has a prefixed width measured transverse to the direction of development of the same base, and wherein the protuberance, of each of said first elements has, at the mid portion defined between two of the immediately consecutive nodes, a respective width measured transverse to the direction of development of the base of the first element, smaller than the width of the base of the first element, and wherein the ratio between the width of the base of each of the first elements and the width of the protuberance of each of the first elements between 2 and 8.

9. The reticular structure according to claim 8, wherein the T-shaped section of each first element, at the mid-portion defined between two of the immediately consecutive nodes, has a height measured orthogonally to the direction of development of the base of the respective first element, and wherein the ratio between the height of the T-shaped section of each first element and the width of the base of the same first element is between 0.7 and 3.

10. The reticular structure according to claim 8, wherein the base of the first elements has a height, measured orthogonally to the direction of development of the base of the first elements, smaller than a height of the protuberance measured orthogonally to the direction of development of the base of the first elements.

11. The reticular structure according to claim 10, wherein the ratio between the height of the protuberance of the first elements and the height of the base of the first elements is greater than 1.2, and wherein the ratio between the height of the protuberance of the first elements and the width of the base of the first elements is between 0.5 and 2.

12. The reticular structure according to claim 1, comprising a filtering element engaged with at least one of said first and second elements.

13. The reticular structure according to claim 12, wherein the filtering element is stably constrained at a top portion of the protuberances of the first elements, opposed to the base of said first elements.

14. The reticular structure according to claim 12, wherein the filtering element defines, in cooperation with each mesh, a seat configured to receive gravel and/or rubble.

15. The reticular structure according to claim 12, wherein the filtering element is stably constrained at a top portion of a plurality of protuberances of the second elements, opposed to the base of said second elements.

* * * * *